US006438840B2

(12) United States Patent
Tavi et al.

(10) Patent No.: US 6,438,840 B2
(45) Date of Patent: Aug. 27, 2002

(54) METHOD OF MAKING CONTINUOUS CORRUGATED HEAT EXCHANGER

(75) Inventors: Joseph Paul Tavi, Novi, MI (US); James Harvey Hornsby, IV; Daniel Paul Massman, both of Connersville, IN (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/870,360

(22) Filed: May 30, 2001

Related U.S. Application Data

(62) Division of application No. 09/470,372, filed on Dec. 22, 1999, now Pat. No. 6,269,869.

(51) Int. Cl.[7] ..... B23P 15/26
(52) U.S. Cl. ..... 29/890.039; 29/890.03
(58) Field of Search ..... 29/890.03, 890.039; 72/363, 379.2, 379.6

(56) References Cited

U.S. PATENT DOCUMENTS

| | | | |
|---|---|---|---|
| 3,258,832 | A | 7/1966 | Gerstung |
| 3,292,690 | A | 12/1966 | Donaldson |
| 5,409,056 | A | 4/1995 | Farry, Jr. et al. |
| 5,431,217 | A | 7/1995 | Kadle et al.. |
| 5,507,338 | A | 4/1996 | Schornhorst et al. |
| 5,732,460 | A | 3/1998 | Paternoster et al. |
| 5,855,240 | A | 1/1999 | Farrell et al. |
| 5,937,935 | A | 8/1999 | Schornhorst et al. |
| 6,269,869 | B1 | 8/2001 | Tavi et al. |

*Primary Examiner*—I Cuda Rosenbaum
(74) *Attorney, Agent, or Firm*—Larry I. Shelton

(57) ABSTRACT

A method of making a continuous corrugated heat exchanger includes stamping a plurality of contiguous refrigerant plates joined together by a plurality of tabs. The method includes the steps of stamping at least a first and last one of the refrigerant plates flat to form end sheets. The method further includes the steps of bending the refrigerant plates to form a stack and bending the end sheets over the refrigerant plates at a top and bottom of the stack.

12 Claims, 2 Drawing Sheets

METHOD OF MAKING CONTINUOUS CORRUGATED HEAT EXCHANGER

This application is a division of application Ser. No. 09/470,372, filed Dec. 22, 1999, now U.S. Pat. No. 6,269, 869.

BACKGROUND OF THE INVENTION

1. Field of the Invention

The present invention relates generally to heat exchangers and, more specifically, to a continuous corrugated heat exchanger and method of making same for a motor vehicle.

2. Description of the Related Art

It is known to provide a folded or corrugated plate heat exchanger such as an oil cooler in a motor vehicle. Typically, the heat exchanger has a plurality of elongated plates that are joined together to define a plurality of fluid passageways therethrough. Each of the passageways is formed between inwardly facing surfaces of a joined pair of mating plates. The interiors of these joined mating plates define fluid passageways through which a first fluid medium to be cooled may flow. The heat exchangers also include conductive fins disposed between adjacent pairs of mating plates to enhance the heat exchange between the fluid flowing through the fluid passageways thereof while a second fluid medium contacts an exterior thereof. Typically, the first fluid medium is oil and the second fluid medium is air. Where a temperature difference exists between the first and second fluid mediums, heat will be transferred between the two via heat conductive walls of the plates.

Typically, folded plate heat exchangers are manufactured by stacking individual plates together to form a plurality of adjacent pairs, then interleaving the pairs of mating plates with conductive fins to form a stacked plate structure. End plates are then placed at opposite ends of the stacked plate structure to form a heat exchanger core. The assembled heat exchanger core is then brazed in a furnace to complete the manufacturing process. This is an extremely labor intensive process requiring human assemblers to physically stack the individual plates with each other to form the heat exchanger core prior to being brazed.

One proposed method, which may increase the productivity in fabricating corrugated heat exchangers, are disclosed in U.S. Pat. Nos. 5,734,460 and 5,855,240. These patents disclose a method of making a heat exchanger wherein a plurality of individual plates are stamped from a single sheet of material and inter-linked together by tab members. Each tab member is a straight piece of metal material that connects the plates and provides a location for bending to occur. After being formed, the plates are folded in a zig-zag formation to form a heat exchanger core. Each core has end sheets to seal off the core and provide a structure to which inlet and outlet tubes can be brazed, and to provide damage protection to the core. These end sheets, two per core, are stamped out separately, in a unique end sheet die, then manually assembled to the core. The end sheets are stamped out of 0.060 inches thick material, which is different than the core material thickness of 0.0195 inches.

Although the above heat exchangers have worked well, it is desirable to eliminate the use of separate end sheets for the stacked refrigerant plates of the heat exchanger. It is also desirable to provide a continuous corrugated laminated end sheet for a heat exchanger. It is further desirable to provide a continuous corrugated heat exchanger and method of making same.

SUMMARY OF THE INVENTION

Accordingly, the present invention is a continuous corrugated heat exchanger including a plurality of contiguous plates and a plurality of tabs disposed between and joined to adjacent plates. The plates include a plurality of refrigerant plates having a plurality of beads and at least one blank sheet at each end of the refrigerant plates forming an end sheet. The refrigerant plates are folded bellows-like to form a stack and the end sheet is folded on a top and bottom of the stack.

Also, the present invention is a method of making a continuous corrugated heat exchanger. The method includes the steps of stamping a plurality of contiguous refrigerant plates joined together by a plurality of tabs and stamping at least a first and last one of the refrigerant plates flat to form an end sheet. The method also includes the step of bending the refrigerant plates to form a stack and bending the end sheets over the refrigerant plates at a top and bottom of the stack.

One advantage of the present invention is that a continuous corrugated heat exchanger such as an oil cooler is provided for a motor vehicle for cooling liquid oil. Another advantage of the present invention is that the continuous corrugated heat exchanger has continuous corrugated laminated end sheets for the stacked plate structure of the heat exchanger core. Yet another advantage of the present invention is that the continuous corrugated heat exchanger uses regular refrigerant plates as end sheets, stamping out a complete heat exchanger core. Still another advantage of the present invention is that the continuous corrugated heat exchanger has higher strength, much simpler manufacturing, higher quality and lower cost.

Other features and advantages of the present invention will be readily appreciated, as the same becomes better understood, after reading the subsequent description taken in conjunction with the accompanying drawings.

DESCRIPTION OF THE PREFERRED EMBODIMENT(S)

Figure 1:
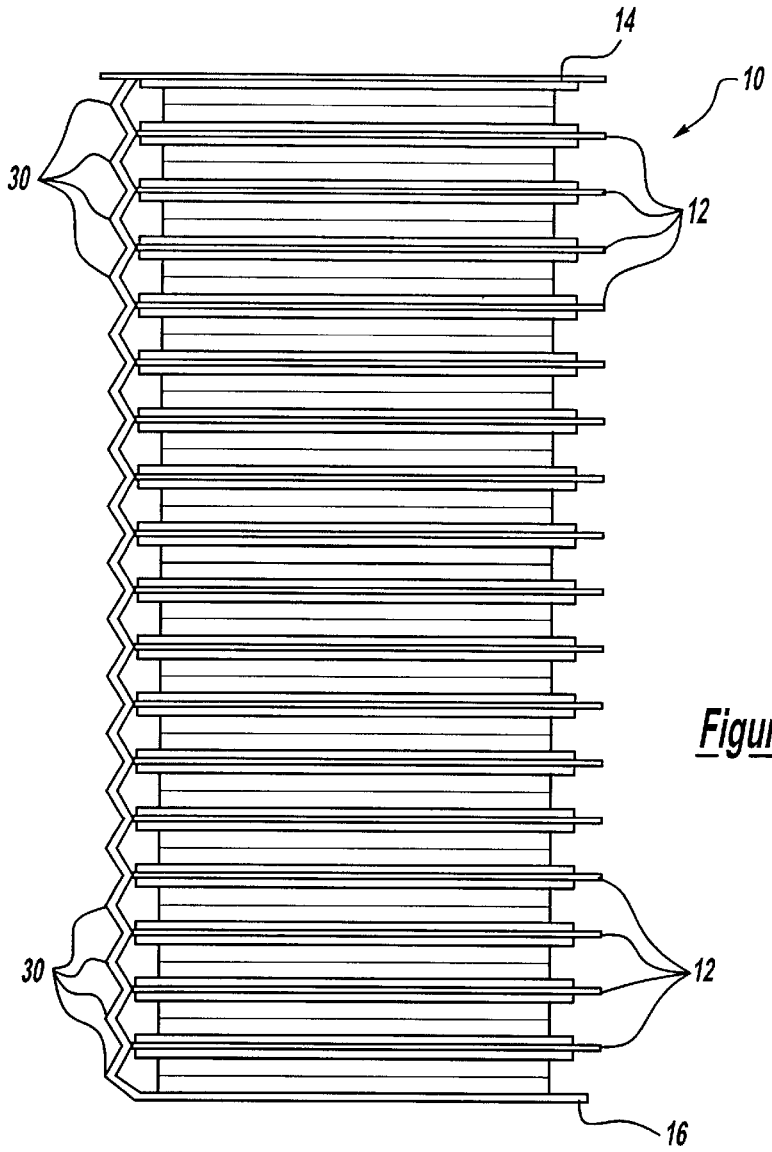
FIG. 1 is an elevational view of a continuous corrugated heat exchanger, according to the present invention.
Figure 2:
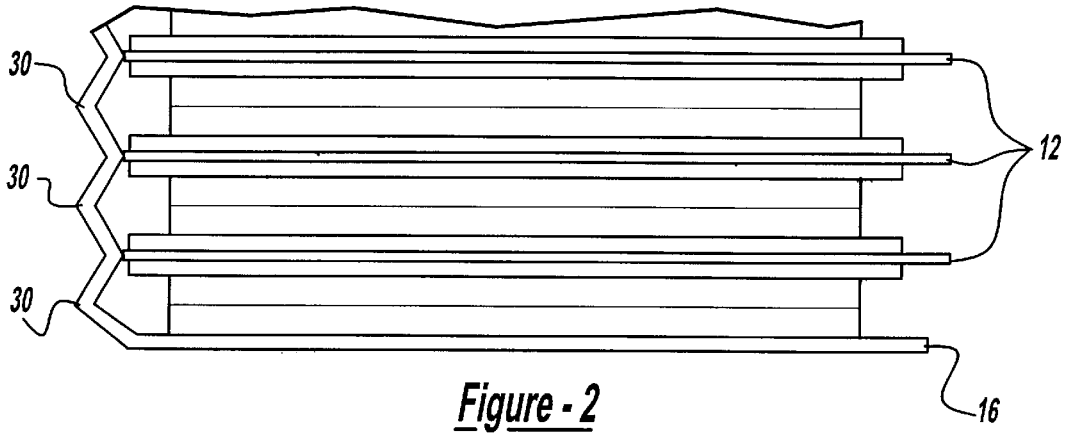
FIG. 2 is an enlarged view of a portion of the continuous corrugated heat exchanger of FIG. 1.
Figure 3:
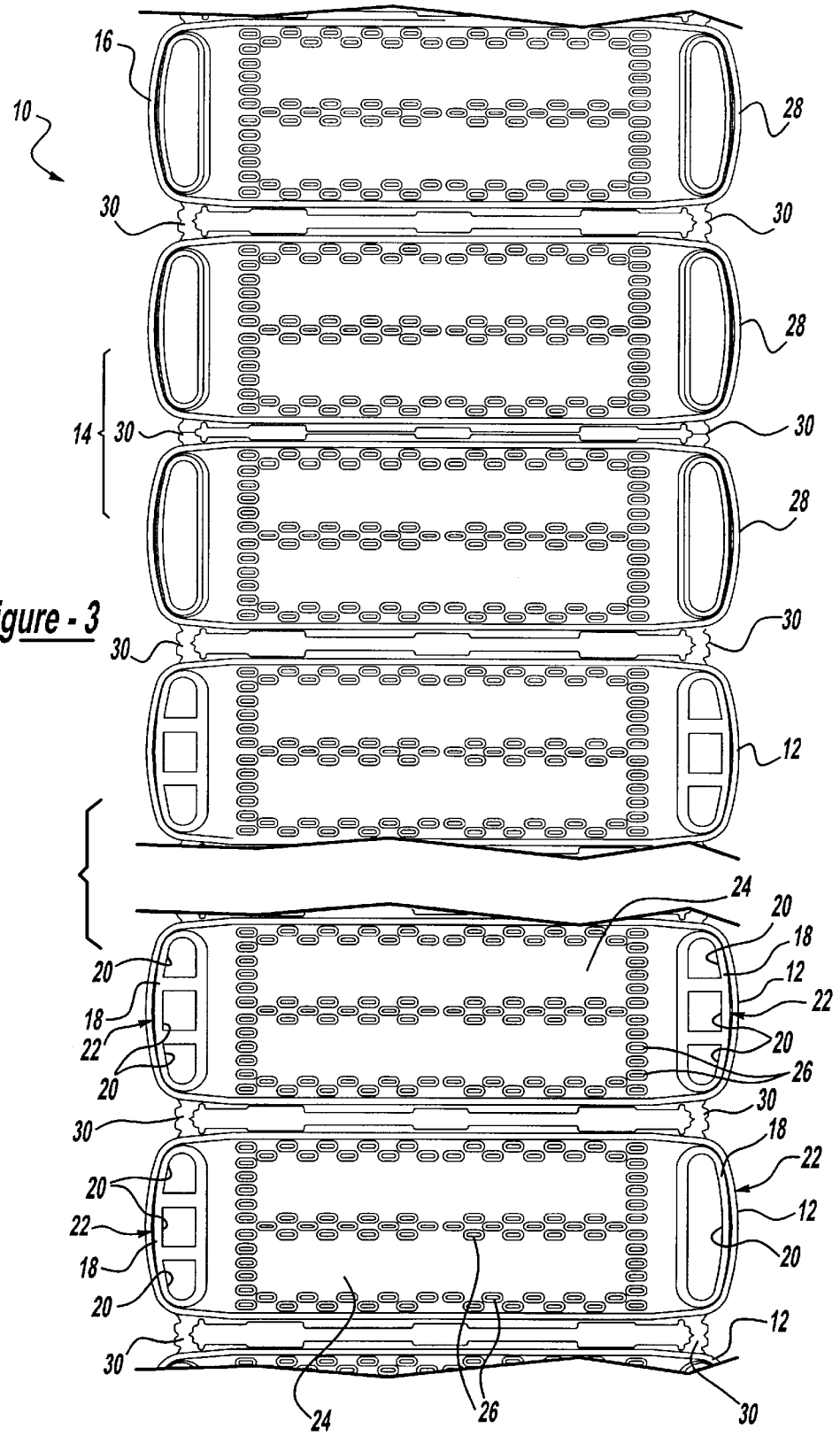
FIG. 3 is a top view of the continuous corrugated heat exchanger of FIG. 1 illustrating a strip of the plates preformed.

Referring to the drawings and in particular FIGS. 1 through 3, one embodiment of a continuous corrugated heat exchanger 10, according to the present invention, such as an oil cooler, evaporator or condenser, is shown for a motor vehicle (not shown). The continuous corrugated heat exchanger 10 includes a plurality of generally parallel refrigerant plates 12, pairs of which are joined together in a face-to-face relationship to form a stack. The continuous corrugated heat exchanger 10 further includes oppositely disposed first and second mounting plates or end sheets 14 and 16 at ends of the stack. The continuous corrugated heat exchanger 10 includes a fluid inlet (not shown) for conducting fluid into the heat exchanger 10 and an outlet (not shown) for directing fluid out of the heat exchanger 10. It should be appreciated that the continuous corrugated heat exchanger 10 could be used for other applications besides motor vehicles.

Referring to FIGS. 1 through 3, the refrigerant plate 12 extends longitudinally and is substantially planar or flat. The refrigerant plate 12 includes a raised boss 18 on each end and may have at least one aperture 20 extending therethrough. The bosses 18 are stacked together such that the apertures 20 are aligned to form a flow header, generally indicated at 22, to allow parallel flow of fluid through the refrigerant plates 12. It should be appreciated that such flow headers 22 are conventional and known in the art.

The refrigerant plate 12 includes a surface 24 being generally planar and extending longitudinally and laterally. The refrigerant plate 12 also includes a plurality of beads 26 extending above and generally perpendicular to a plane of the surface 24 and spaced laterally from each other. The beads 26 are generally elongated in shape. It should be appreciated that the beads 26 on each refrigerant plate 12 are aligned with each other.

The end sheets 14 and 16 are formed by blank plates 28 stamped from two to four of the refrigerant plates 12. Preferably, the top end sheet 14 is formed by stamping two of the refrigerant plates 12 flat to form two blank plates 28 and the bottom end sheet 16 is formed by stamping four of the refrigerant plates 12 flat to form four blank plates 28. Preferably, the blank plates 28 have a predetermined thickness such as 0.019 inches to form the top end sheet 14 having a thickness of 0.038 inches and the bottom end sheet 16 having a thickness of 0.076 inches. It should be appreciated that the blank plates 28 are stamped out of two to four additional refrigerant plates 12 in the same die as the refrigerant plates 12 are made.

As illustrated in FIG. 3, the refrigerant plates 12 and blank plates 28 are formed from a single sheet of material and are interconnected by deformable tabs 30 to be described. The material can be an aluminum material coated with an aluminum brazing alloy as is known in the art. A sheet of material can either be of a predetermined length with a predetermined number of plates 12 and 28 or may be formed as a continuous strip of material, which is cut at a predetermined number of plates 12 and 28 to form the heat exchanger 10 of a predetermined size. The plates 12 and 28 are stamped using pneumatic and/or hydraulic activated details in a die controlled by a PLC\PLS or other computerized means known in the die pressing art. In the embodiment illustrated, a pair of the refrigerant plates 12 is arranged such that the beads 26 contact each other to turbulate fluid flow therethrough. It should be appreciated that the beads 26 are brazed to each other. It should also be appreciated that the entire heat exchanger 10 is brazed together as is known in the art.

The continuous corrugated heat exchanger 10 includes a first set and a second set of the deformable tabs 30 connecting the refrigerant plates 12 and blank plates 28 together. As illustrated, each first set of tabs 30 connects adjacent refrigerant plates 12 and blank plates 28 near one end and each second set of tabs 30 connects adjacent refrigerant plates 12 and blank plates 28 near an opposite end. The tabs 30 extend transversely from one plate 12,28 to another 12,28 and are formed as part of a rail edge of each plate 12,28. The tabs 30 are made from the same material as the plates 12,28 and are plastically deformable. The tabs 30 have a single bend zone which allows for much more narrow bending to accomplish good plate-to-plate contact during the forming of the continuous corrugated heat exchanger 10 by the bellows-like or zig-zag folding, of the contiguous plates 12 and 28. It should be appreciated that the tabs 30 are similar to those disclosed in U.S. Pat. Nos.: 5,507,338; 5,732,460; 5,855,240; and 5,937,935, the disclosures of which are hereby incorporated by reference.

To manufacture the contiguous corrugated heat exchanger 10 according to a method of the present invention, the method includes the step of stamping the plates 12 and 28 and tabs 30 from the sheet of material. The refrigerant plates 12 can be stamped in a single stroke of a die (not shown). The method includes the step of forming the refrigerant plates 12 having a generally planar surface 24 and a plurality of beads 30 extending above the surface 24. The method includes punching the apertures 20 in the raised bosses 18. The blank plates 28 are formed by stamping two to four additional refrigerant plates 12 flat in the same die as the refrigerant plates 12. The die stamps out two blank plates 28 at the beginning of the refrigerant plates 12, stamps the refrigerant plates 12, and stamps out four blank plates 28 at the tail end of the refrigerant plates 12 forming the core, but all still connected by the tabs 30. The die then stamps the first two refrigerant plates 12 flat which form the top end sheet 14 and the last four refrigerant plates 12 flat which form the bottom end sheet 16. The method includes the step of bending the refrigerant plates 12 at the bend zones in the sets of tabs 30 into folds so that adjacent refrigerant plates 12 are in abutting, face-to-face relationship. The method includes the step of disposing fins (not shown) between adjacent refrigerant plates 12 during the bending of the refrigerant plates 12. It should be appreciated that, alternatively, the blank plates 28 may include beads 30, which are stamped flat in a restrike station in the die (not shown).

The method includes the step of bending the blank plates 28 at the bend zones in the sets of tabs 30 into folds so that two of the blank plates 28 are folded up at the top of the core of refrigerant plates 12 to form the top end sheet 14 and so that four of the blank plates 28 are folded up at the bottom of the core of refrigerant plates 12 to form the bottom end sheet 16. The method includes the steps of placing the contiguous corrugated heat exchanger 10 into a brazing furnace (not shown) and passing the contiguous corrugated heat exchanger 10 through a vacuum brazing operation in which the metal brazes together to form the completed contiguous corrugated heat exchanger 10. It should be appreciated that the tabs 30 interconnecting the last blank plate 28 forming the bottom end sheet 16 and the first blank plate 28 forming the top end sheet 14 are severed. It should also be appreciated that the blank plates 28 are laminated to each other by the aluminum brazing alloy thereon.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A method of making a continuous corrugated heat exchanger comprising the steps of:

stamping a plurality of contiguous refrigerant plates joined together by a plurality of tabs;

stamping at least a first and last one of the refrigerant plates flat to form end sheets; and bending the refrigerant plates to form a stack and bending the end sheets over the refrigerant plates at a top and bottom of the stack.

2. A method as set forth in claim 1 wherein said step of forming comprises forming the refrigerant plates with a plurality of beads.

3. A method as set forth in claim 1 wherein said step of stamping comprises stamping at least two refrigerant plates flat to form two blank plates at each end of the refrigerant plates.

4. A method as set forth in claim 1 wherein said step of stamping comprises stamping two refrigerant plates flat at a beginning of the refrigerant plates to form two blank plate s at the top end of the refrigerant plates.

5. A method as set forth in claim 1 wherein said step of stamping comprises stamping four refrigerant plates flat at an end of the refrigerant plates to form four blank plates at the bottom end of the refrigerant plates.

6. A method as set forth in claim 1 including the step of brazing a plurality of the end sheets together to form a laminated end sheet.

7. A method as set forth in claim 6 wherein said step of stamping includes forming raised bosses on ends of the refrigerant plates.

8. A method as set forth in claim 7 including the step of punching apertures through the raised bosses.

9. A method as set forth in claim 1 wherein said step of bending comprises bending the tabs to fold the refrigerant plates and end sheets in a bellows-like manner.

10. A method as set forth in claim 1 including the step of brazing the refrigerant plates and end sheets together.

11. A method of making a continuous corrugated heat exchanger comprising the steps of:

stamping a plurality of contiguous refrigerant plates joined together by a plurality of tabs;

stamping at least a first and last one of the refrigerant plates flat to form end sheets having blanked end portions being joined to one of the refrigerant plates by the tabs; and bending the refrigerant plates to form a stack and bending the end sheets over the refrigerant plates at a top and bottom of the stack.

12. A method of making a continuous corrugated heat exchanger comprising the steps of:

stamping a plurality of contiguous refrigerant plates having a plurality of beads and joined together by a plurality of tabs disposed between the refrigerant plates;

stamping at least a first and last one of the refrigerant plates flat to form end sheets having blanked end portions being joined to one of the refrigerant plates by the tabs; and bending the refrigerant plates to form a stack and bending the end sheets over the refrigerant plates at a top and bottom of the stack.

* * * * *